US006301197B1

(12) United States Patent
Abbott et al.

(10) Patent No.: US 6,301,197 B1
(45) Date of Patent: Oct. 9, 2001

(54) TIMING CHIP RETAINER

(75) Inventors: Amy Abbott, Park City; John C. Bishop, Sandy, both of UT (US)

(73) Assignee: Chisco, Inc., Salt Lake City, UT (US)

( * ) Notice: Subject to any disclaimer, the term of this patent is extended or adjusted under 35 U.S.C. 154(b) by 0 days.

(21) Appl. No.: 09/467,630

(22) Filed: Dec. 20, 1999

(51) Int. Cl.[7] ..... G04B 47/00; G04B 10/00; G04B 37/00

(52) U.S. Cl. ..... 368/10; 368/107; 368/316

(58) Field of Search ..... 368/10, 88, 107–113, 368/276, 278, 316, 317

(56) References Cited

U.S. PATENT DOCUMENTS 3,763,646 * 10/1973 Jeanmonod .

4,637,732 * 1/1987 Jones et al. ..... 368/109

* cited by examiner

*Primary Examiner*—Vit Miska
(74) *Attorney, Agent, or Firm*—Morriss, Bateman, O'Bryant & Compagni

(57) ABSTRACT

A timing chip-engaging retainer device is disclosed which is structured to releasably and selectively engage a timing device or chip of the type worn by athletes in endurance races or other timed sporting activities so that the timing chip may be easily and quickly attached to the athlete's apparel, such as an athletic shoe, and easily and quickly detached from the athlete's apparel without cutting or otherwise harming the athlete's apparel, as is currently the practice in removing timing chips from athletic shoes.

3 Claims, 2 Drawing Sheets

TIMING CHIP RETAINER

BACKGROUND

1. Field of the Invention

This invention relates to electronic timing and location devices worn by endurance athletes competing in races, and specifically relates to retainer devices for releasably attaching such timing and location devices to an athlete's clothing.

2. Statement of the Art

Marathon and other endurance races have been run for many years, but have become increasingly more popular in the past two decades. With the increased popularity of endurance races has come an increase in the number of participants involved in endurance races. Large races, such as the New York marathon, can have over thirty thousand participants running the race. It has thus become increasingly more difficult to monitor the high number of participants in a competition and, more importantly, to monitor the progress of the race. In recent years, there have even been a number of incidences of front-runners having, in reality, exited and re-entered the course in order to improve their time and position in the race. Unscrupulous athletes are able to take advantage of the course because of the high number of participants and spectators lining the course.

More importantly, obtaining exacting statistics relating to race times has been difficult in the past because of the high number of participants and ineffective monitoring systems. In recent years, however, new timing devices have been developed which enables more accurate monitoring of each runner and improved collection of timing data. Timing devices, such as those manufactured by ChampionChip Holding B.V. of The Netherlands, are worn by the athletes, particularly on the athlete's shoes, and major endurance race organizers are now requiring all participants to wear timing devices because of the accuracy of the timing and location data that can be obtained.

Prior to the beginning of a race, the athlete is provided with a timing device by the race officials and is required to attach the timing device to the athlete's shoes; that is, by feeding the device through the laces of his or her shoes and tying the timing device in place on the shoe. As the athletes move along the course of the race, they pass check points at which an electronic receiving device is stationed. The timing devices are structured with a transponder which sends a signal detectable by the receiver. Thus, as the body of athletes passes each check point in the length of the course, the receiving device can detect the presence and relative time of each participant's movement through the course. At the end of the race, the participants are required to return the timing device to the race officials, which typically involves cutting of the shoelaces to release the timing device from the shoe.

Because attachment of the timing device to the runner's shoelaces can be timeconsuming, can result in loss of the timing device if the laces come untied and can result in damage to the shoes from cutting the shoelaces to remove the timing device at the end of the race, it would be advantageous to provide a retainer structured to releasably engage a timing device on an article of athletic clothing in a manner which enables ease of attachment, which prevents loss of the device during the race and which prevents damage to the athlete's clothing when the timing device is removed for returning to the race officials.

SUMMARY OF THE INVENTION

In accordance with the present invention, a timing chip-engaging retainer device is provided which is configured to engage a timing device, or chip, for retention on an item of athletic clothing in a manner which allows quick and selective release of the timing device from the item of clothing, thereby facilitating ease of attachment of the timing device to the athlete and ease of removal of the timing device at the end of the race. Although the retainer device of the present invention is suitable for use in attaching a timing device or chip to a variety of items of athletic clothing, the invention is described herein with respect to configuration for attachment to athletic shoes.

The retainer device of the present invention generally comprises a body member which is configured for engaging a timing device (also referred to herein as a "timing chip") in a selectively releasable manner, thereby enabling fast and secure engagement of the timing chip to the article of clothing and fast release of the timing chip from engagement with the article of clothing. The body member of the retainer device is further configured with a clothing support which provides support of the body member on or in an article of athletic clothing. A particularly suitable clothing support may comprise lacing supports through which the shoelace of a shoe is strung to secure the retainer device to an athletic shoe. The body member further comprises selectively releasable securement structure for maintaining the timing chip in secure, but temporary engagement with the body member of the retainer device.

BRIEF DESCRIPTION OF THE ILLUSTRATIONS

In the drawings, which illustrate what is currently considered to be the best mode for carrying out the invention:

DETAILED DESCRIPTION OF THE INVENTION

Figure 1:
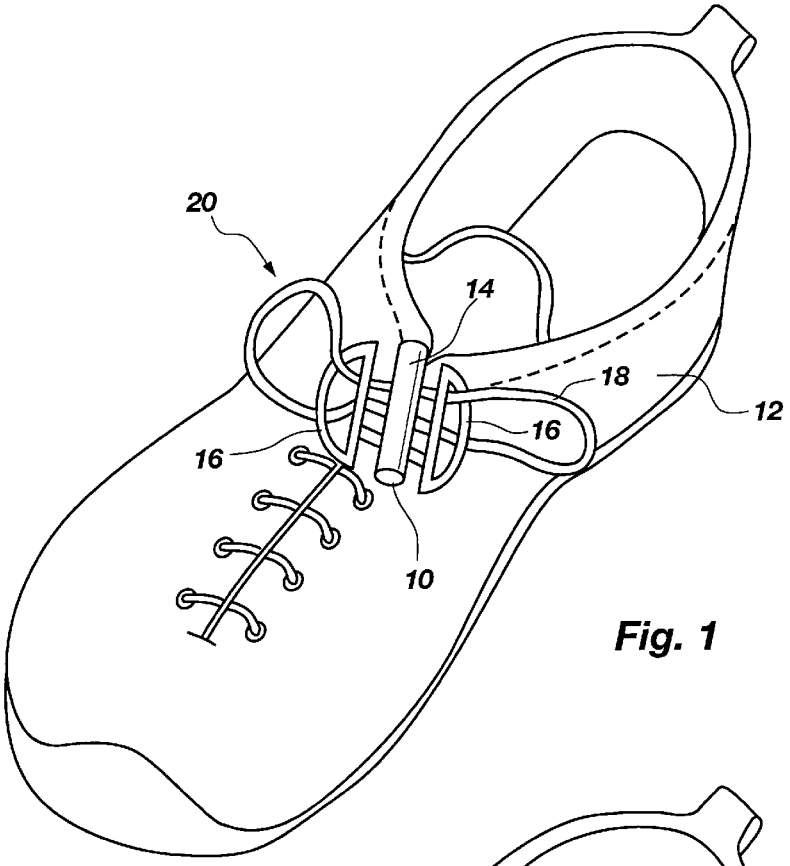
FIG. 1 is a perspective view of an athletic shoe illustrating a conventional method of attaching a timing chip to a shoe via the laces.
Figure 2:
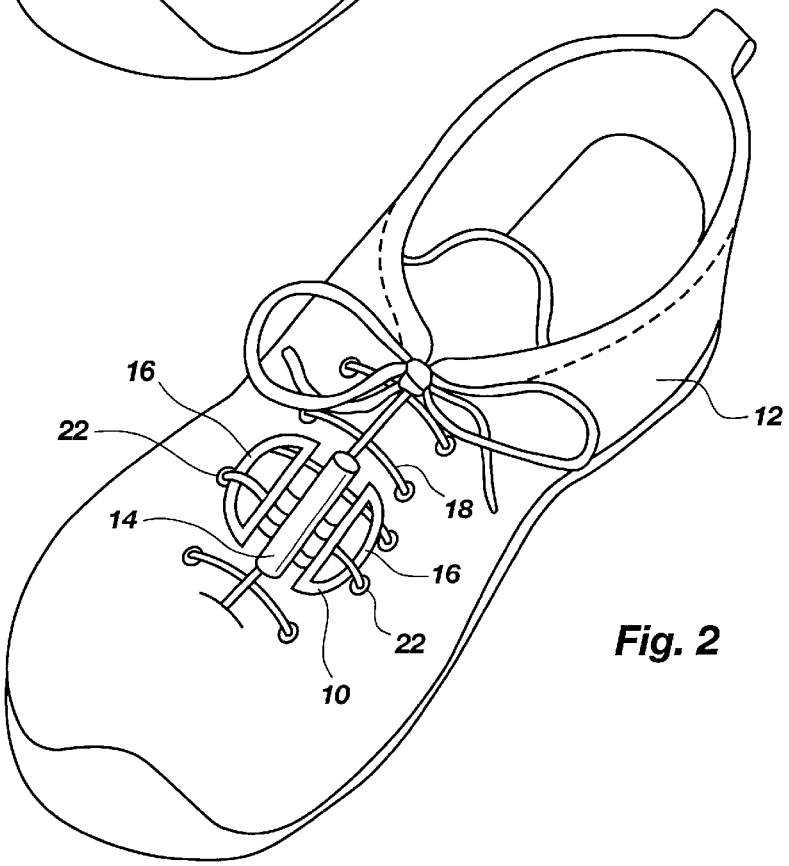
FIG. 2 is a perspective view of an athletic shoe illustrating an alternative conventional method for attaching a timing chip to an athletic shoe.

FIGS. 1 and 2 illustrate a conventional timing chip 10 of the type used by athletes in endurance racing, and specifically show two alternative ways of attaching the timing chip 10 to an athletic shoe 12. Timing chips 10 generally are constructed with a housing 14 inside which is maintained the transponder or other electronic signal-generating structures of the timing chip. Timing chips 10 are also structured with attachment means 16 for securing the timing chip 10 to an article of the athlete's clothing, such as a shoe. In the example illustrated in FIGS. 1 and 2, the timing chip 10 is structured with opposing D-shaped rings 16 through which the laces 18 of a shoe may be strung to secure the timing chip 10 to a shoe 12. As shown in FIG. 1, the timing chip 10 may be knotted into the bow 20 formed from tying the loose ends of the shoelaces 18. Tying the timing chip 10 into the bow 20, however, may result in the timing chip 10 being lost if the bow 20 becomes untied during the race. Alternatively, as shown in FIG. 2, the timing chip 10 may be engaged by lacing the shoelaces 18 through the D-shaped rings 16 of the timing chip 10 while lacing the shoelaces through the grommets 22 of the shoe 12.

At the completion of a race or event, the timing chip 10, which is typically provided by the race officials, must be returned to the race officials for future use. As typically occurs, the shoelaces of the race participant are severed to quickly release the timing chip from the shoelaces. Severing of the shoelaces is particularly required when the timing chip is secured in place as shown in FIG. 2. Even if the timing chip is tied into the bow of the shoelaces, however, removal of the timing chip may be complicated by an elaborate tying or knotting of the bow which was done to keep the bow from coming untied during the race, and in many instances the bow is cut or severed to quickly release the timing chip.

Figure 3:
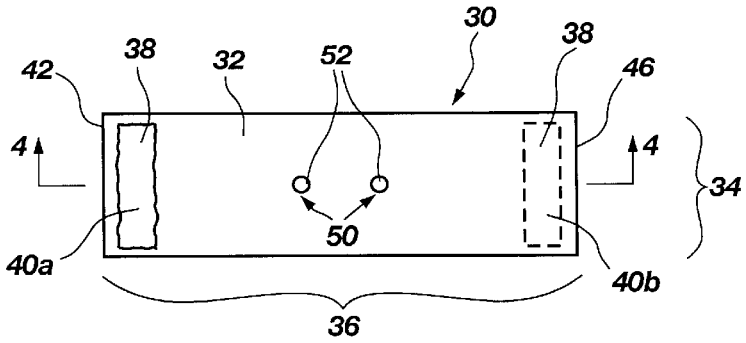
FIG. 3 is a plan view of a retainer device of the present invention.
Figure 4:
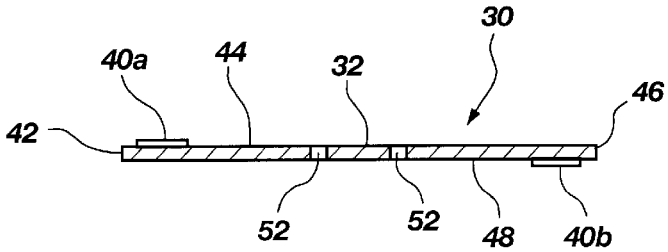
FIG. 4 is a view in cross section of the retainer device shown in FIG. 3, taken at line 4—4.
Figure 5:
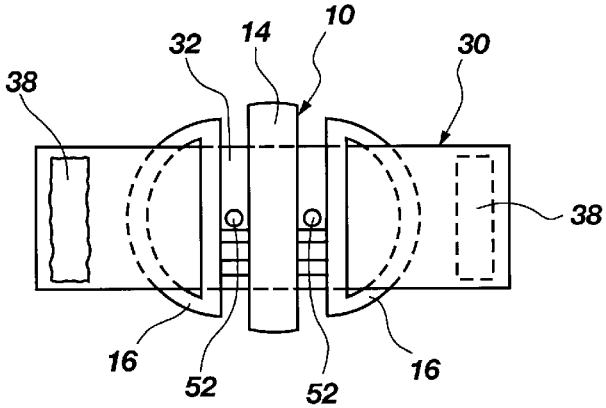
FIG. 5 is a plan view of the retainer device shown in FIG. 3, where a timing chip is partially engaged by the retainer device.
Figure 6:
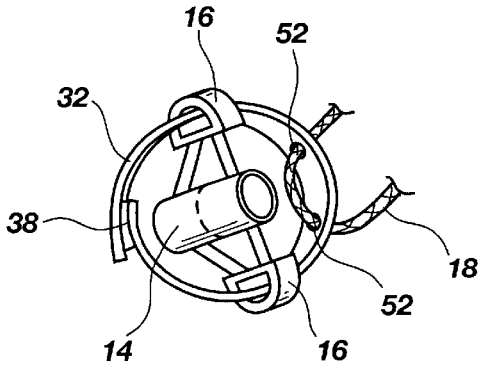
FIG. 6 is a perspective view of the retainer device shown in FIG. 5 engaging a timing chip and secured to a shoelace.

The timing chip-engaging retainer device 30 of the present invention, an exemplar configuration of which is shown in FIG. 3, enables the timing chip 10 to be releasably secured to, for example, the shoelaces of an athletic shoe to enable quick and easy attachment and detachment of the timing chip from the participant's shoe. The retainer device 30 comprises a body member 32 which is structured to engage a portion of a timing chip to secure the timing chip thereto. In the exemplar embodiment of the invention shown in FIG. 3, the body member 32 is structured with a first end 42 and a second end 46 which are each respectively insertable into one of the D-shaped rings 16 of the timing chip 10, as shown in FIG. 5, to engage the D-shaped rings. However, the configuration of the body member 32 may be any suitable configuration which is capable of engaging a portion of a timing chip 10 which has a different configuration from the example shown in FIGS. 1, 2 and 5. In the embodiment of the invention illustrated in FIG. 3, the body member 32 is configured as a rectangular-shaped piece of flexible fabric which is sized in width 34 to be received through the D-shaped rings 16 of the timing chip 16, as shown in FIG. 5. The body member 32 is also sized in length 36 to encircle the housing 14 of the timing chip 10, as shown in FIG. 6.

The retainer device 30 of the present invention is also configured with selectively releasable securement structure 38 which enables the timing chip 10 to be selectively released or disengaged from the retainer device 30. The selectively releasable securement structure 38 may be any suitable means, device or structure capable of quickly securing the retainer device to and releasing the retainer device from a timing chip 10. By way of example only, FIGS. 3–6 illustrate an embodiment of the invention where the selectively releasable securement structure 38 is a portion of interlocking hook and loop material 40*a*, 40*b*, one portion 40*a* of which is located at the first end 42 of the body member 32 on a first surface 44 thereof, and the other interlocking portion 40*b* is located at the second end 46 of the body member 32 and positioned on the opposing, second surface 48 of the body member 32, as illustrated more fully in FIG. 4. Alternatively, the body member 32 may be made entirely of a length of self-engaging material having the hook side of the fabric on, for example, the first surface 44 and the loop side of the fabric on the second surface 48. Any number of other selectively releasable securement structures may be employed, however, including snaps, clips, buckles or the like.

The timing chip-engaging retainer device 30 of the present invention further includes clothing supports 50 configured to secure the body member 32 to an article of clothing worn by the athlete. By way of example only, the body member 32 may be structured with two apertures 52 through which a shoelace 18 may be strung to secure the retainer device 30 to an athletic shoe, as shown in FIG. 6. The retainer device 30 may thus be attached to the free end of a shoelace 18 by directing the end of the shoelace 18 through first one aperture 52 and then through the other 52. Alternatively, the retainer device 30 may be secured to the shoelace in like fashion as the shoelace is being strung through the grommets of the shoe to secure the retainer device in a place other than on the bow of the shoelaces. In alternative embodiments of the retainer device not shown, the clothing support may, for example, comprise a buttonhole sized to receive a button therethrough. Other clothing supports may be employed as required by the nature of the athletic clothing to which the timing chip is to be detachably attached.

The timing chip-engaging retainer device of the present invention is structured to quickly attach and detach a timing chip from the clothing of an athlete competing in an endurance race or other kind of timed sporting activity, and is specifically designed to avoid the otherwise necessary cutting or destruction of the athletic clothing in an attempt to disengage a timing chip from the athlete's clothing. The timing chip-engaging retainer device may be adapted to any number of timing chip designs that may now exist or be later developed. Thus, reference herein to specific details of the illustrated embodiments is by way of example and not by way of limitation. It will be apparent to those skilled in the art that many modifications of the basic illustrated embodiment may be made without departing from the spirit and scope of the invention as recited by the claims.

What is claimed is:

1. A timing chip-engaging retainer device comprising:

a body member configured to releasably and selectively engage a timing chip;

selectively releasable securement structure positioned on said body member to releasably secure a timing chip to said body member in selective engagement therewith; and a clothing support on said body member for supporting said body member on an article of clothing to provide selective engagement of a timing chip by an article of clothing during a timed sporting activity.

2. The timing chip-engaging retainer device of claim 1 wherein said selectively releasable securement structure is interlocking hook and loop material located along said body member to secure said body member in engagement with a timing chip.

3. The timing chip-engaging retainer device of claim 1 wherein said clothing support is a plurality of apertures positioned on said body member for securing a shoelace therethrough.

* * * * *